US010190286B2

(12) United States Patent
Konrardy et al.

(10) Patent No.: US 10,190,286 B2
(45) Date of Patent: Jan. 29, 2019

(54) DEBRIS DEFLECTION APPARATUS FOR OPERATORS STATION CLEANOUT

(71) Applicant: Deere & Company, Moline, IL (US)

(72) Inventors: Kristy L. Konrardy, Dubuque, IA (US); Krishnaswamy Nalliappan, Kanchipuram (IN); Joshua C. Heitsman, Moline, IL (US)

(73) Assignee: DEERE & COMPANY, Moline, IL (US)

( * ) Notice: Subject to any disclaimer, the term of this patent is extended or adjusted under 35 U.S.C. 154(b) by 25 days.

(21) Appl. No.: 15/462,942

(22) Filed: Mar. 20, 2017

(65) Prior Publication Data

US 2018/0266077 A1 Sep. 20, 2018

(51) Int. Cl.

| | |
|---|---|
| ***B60J 7/00*** | (2006.01) |
| ***E02F 9/16*** | (2006.01) |
| *E02F 3/34* | (2006.01) |

(52) U.S. Cl.

CPC ..... *E02F 9/16* (2013.01); *E02F 3/3414* (2013.01)

(58) Field of Classification Search

CPC ..... F01P 11/12; A47G 29/1216; A61F 2/013; A01G 23/093; A47L 11/4044; B08B 9/049; B25J 11/008; B25J 11/0085; B25J 3/00; B25J 9/0084

USPC ..... 296/190.08, 198, 97.23

See application file for complete search history.

(56) References Cited

U.S. PATENT DOCUMENTS

| | | | | |
|---|---|---|---|---|
| 3,760,430 A | | 9/1973 | Brenden | |
| 4,134,174 A | * | 1/1979 | Flynn | E03F 9/00 134/104.4 |
| 4,223,702 A | | 9/1980 | Cook | |
| 4,320,556 A | * | 3/1982 | Kimzey | E01H 1/0845 15/340.3 |
| 4,476,668 A | * | 10/1984 | Reilly | A01D 43/0635 56/16.6 |
| 4,643,229 A | | 2/1987 | Hickin | |
| 2008/0010775 A1 | * | 1/2008 | Torno | E01H 1/0854 15/340.3 |
| 2012/0205945 A1 | * | 8/2012 | Taylor | B60N 3/06 296/190.08 |
| 2012/0208446 A1 | * | 8/2012 | Taylor | B60H 1/00378 454/158 |
| 2017/0027401 A1 | * | 2/2017 | Windmeisser | A47L 11/305 |
| 2017/0082184 A1 | * | 3/2017 | Gutteridge | B60K 17/10 |

OTHER PUBLICATIONS

Gary, "ProMaster Camper Van Conversion—Plumbing and the Fresh and Grey Water Tanks", Build It Solar [online], Oct. 1, 2014. [Retrieved on Jul. 26, 2016], Retrieved from the Internet: <URL: http://www.builditsolar.com/Projects/Vehicles/PMRV/Plumbing/Plumbing.htm>.

SAUVAGE76, "Montage de réservoirs d'eau propre et usées" Caravane Infos [online]. [Retrieved on Feb. 26, 2016], Retrieved from the Internet: <URL: http://www.caravane-infos.net/site/technique/eau/207-montage-de-reservoirs-deau-propre-et-usees.html>.

* cited by examiner

*Primary Examiner* — Kiran B Patel

(57) ABSTRACT

A debris deflection apparatus for work vehicles to prevent debris build-up from affecting the operation of work vehicle components within the mainframe of the vehicle and improved efficiency for cleaning the operator's station while reducing maintenance of work vehicle components by providing an apparatus coupled with the debris catch area of an operator's station and communicating to an opening in the work vehicle.

19 Claims, 8 Drawing Sheets

DEBRIS DEFLECTION APPARATUS FOR OPERATORS STATION CLEANOUT

CROSS-REFERENCE TO RELATED APPLICATIONS

N/A

FIELD OF THE DISCLOSURE

The present disclosure relates generally to work vehicles found typically in construction, agricultural, or forestry machinery. More particularly, the present disclosure relates to work vehicles where an operator's station is located directly above one or more work vehicle components of the work vehicle. Specifically, the present disclosure relates to a debris deflection apparatus for preventing debris build-up from affecting the operation of work vehicle components and improved efficiency of cleaning the operator's station.

BACKGROUND

Work vehicles are typically operated in dirty environments with significant debris such dust, dirt, rock gravel and particles of plant matter that can accumulate in the operator's station. The debris in the operator's station is commonly flushed out with water. This mixture of debris and water, referred collectively onwards as debris, exits through one or more apertures in the operator's station falling directly onto the work vehicle components below or onto a belly pan. Keeping work vehicle components clean is critical to the life of the components. An operator may be required to leave the operator's station, dismantle the belly pan from the mainframe of the work vehicle and manually clean out the debris build-up before operation of the work vehicle can continue.

SUMMARY

A debris deflection apparatus for an operator's station of a work vehicle is disclosed. The debris deflection apparatus is positioned within the mainframe of the work vehicle proximally located below the debris catch area of the operator's station. More particularly, the apparatus is adapted to receive debris from the debris catch area. The shape and location of the apparatus keep debris build-up from interfering with the operation of the work vehicle components located within the mainframe and below the operator's station when the debris is flushed from the operator's station during cleaning. The debris deflection apparatus occupies the space between the operator's station and the work vehicle components located within the mainframe. The apparatus also prevents debris build-up in the belly pan of the work vehicle. The debris is flushed out of with water and moved away from inside the operator's station to an opening defined by a surface of the work vehicle while circumventing the work vehicle components and the belly pan area. The apparatus improves the efficiency and ease of cleaning by eliminating the need to disassemble the belly pan from the mainframe when removing build-up from within. Debris may include, but is not limited to dirt, rocks, gravel, grass, etc. The upper perimeter of the debris deflection apparatus is coupled with the bottom surface of the debris catch area through a perimeter seal. The perimeter seal prevents any overflow from the apparatus from leaking onto the work vehicle components by sealing any voids. Similarly, the opposing end of the apparatus that communicates to an opening defined by the work vehicle may also contain a perimeter seal, ensuring flow of debris away from work vehicle components, preventing any leaks onto the work vehicle components within the mainframe. The apparatus may be rigid and can be secured into position to the mainframe of the work vehicle or any extension thereof, through a fastener which may include a flange, trunion, clevise, or other fastener. The apparatus may also comprise a hydrophobic coating or an oleophobic coating.

BRIEF DESCRIPTION OF THE DRAWINGS

The detailed description of the drawings refers to the accompanying figures in which.

DETAILED DESCRIPTION

The following describes one or more example embodiments of the disclosed debris deflection apparatus and debris deflection apparatus assembly, as shown in the accompanying figures of the drawings described briefly above. Various modifications may be contemplated by one of skill in the art.

Figure 1:
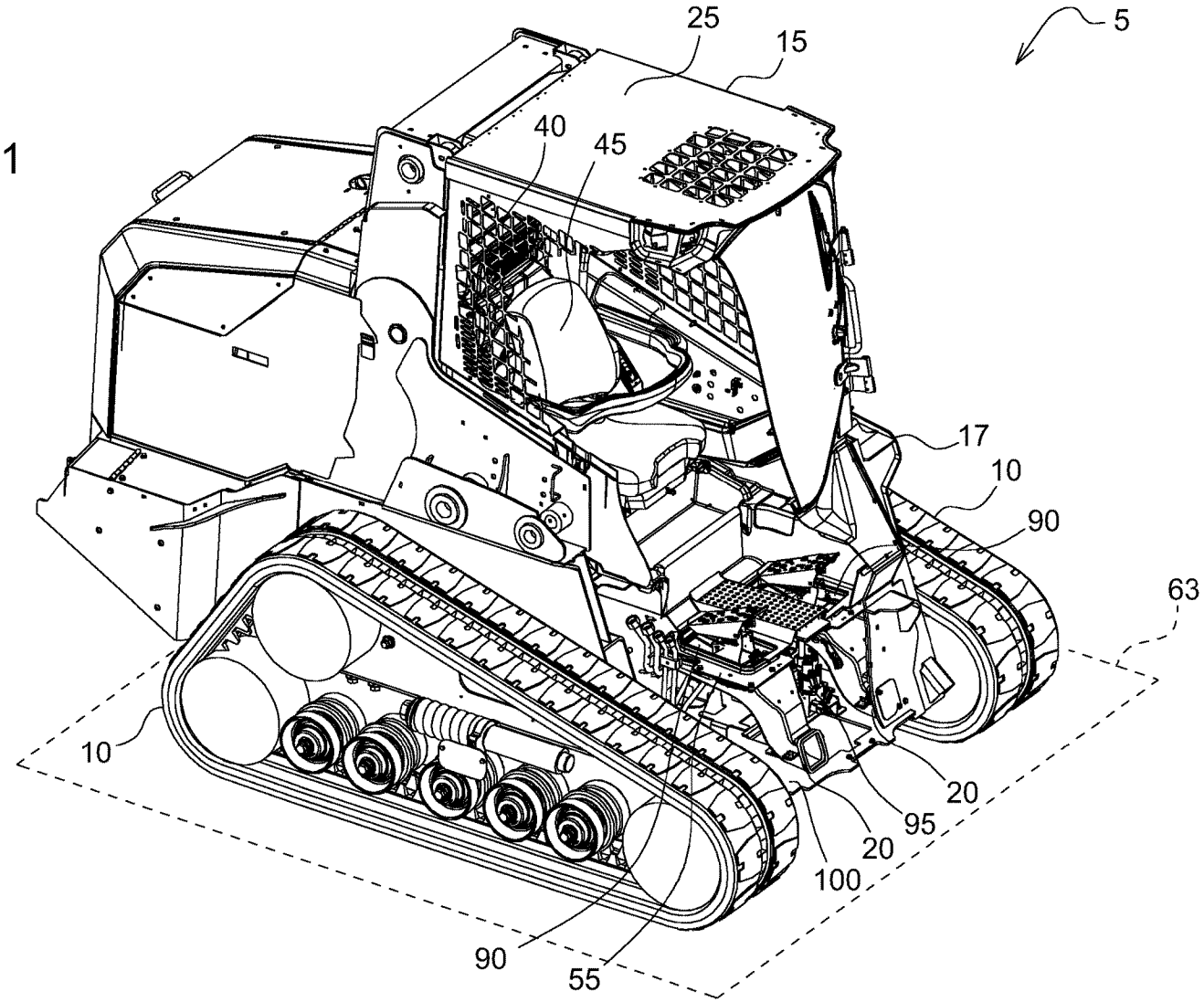
FIG. 1 is a perspective view of a portion of the skid steer loader having the debris deflection apparatus according to one embodiment.
Figure 2:
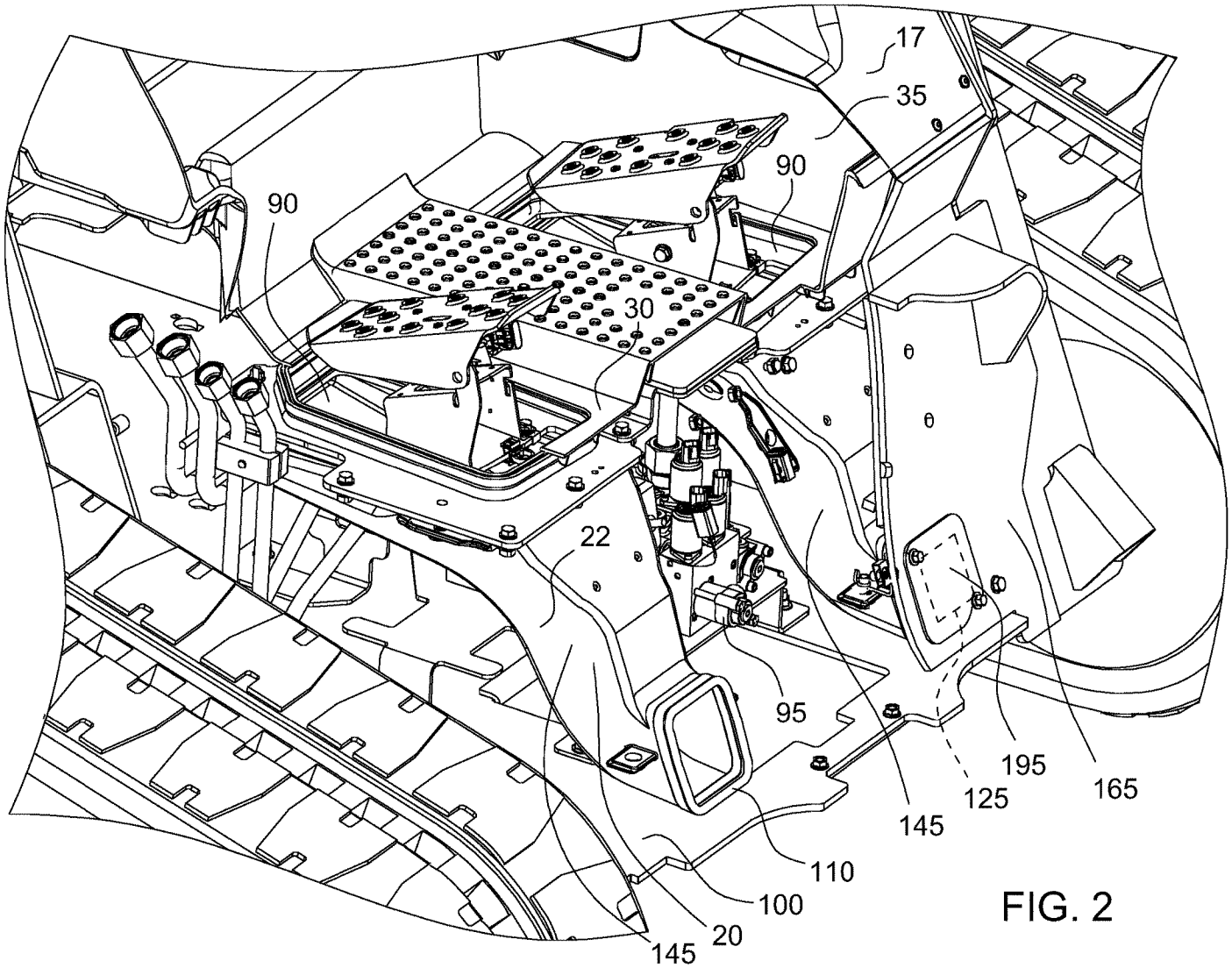
FIG. 2 is a perspective view of a portion of the skid steer loader of FIG. 1 showing the debris deflection apparatus in detail.

Referring to FIG. 1, an exemplary embodiment of a work vehicle 5, such as a skid steer loader, is shown. This disclosure is not intended to be limited to a skid steer loader, however, but rather may include any agricultural, construction, or forestry machinery. The work vehicle 5 is provided with a ground-engaging mechanism 10 for moving along the ground. Work vehicle 5 is equipped with hydraulically powered lift arms (not shown) that jointly carry a bucket or other working tool at their forward ends. An operator's station 15 or enclosure is coupled to a mainframe 17 of the work vehicle 5. A debris deflection apparatus 20 is located below the operator's station 15 and within the mainframe 17 of the work vehicle 5. As will become apparent from the discussion herein, the disclosed debris deflection apparatus 20 may be used advantageously in a variety of settings and with a variety or work vehicles. With reference to FIGS. 1 and 2, more particularly, the debris deflection apparatus 20 is comprised of a deflector 22 positioned to receive debris from a debris catch area 35 and communicate the debris to an opening 125 (FIG. 2) defined by the work vehicle 5.

Figure 4:
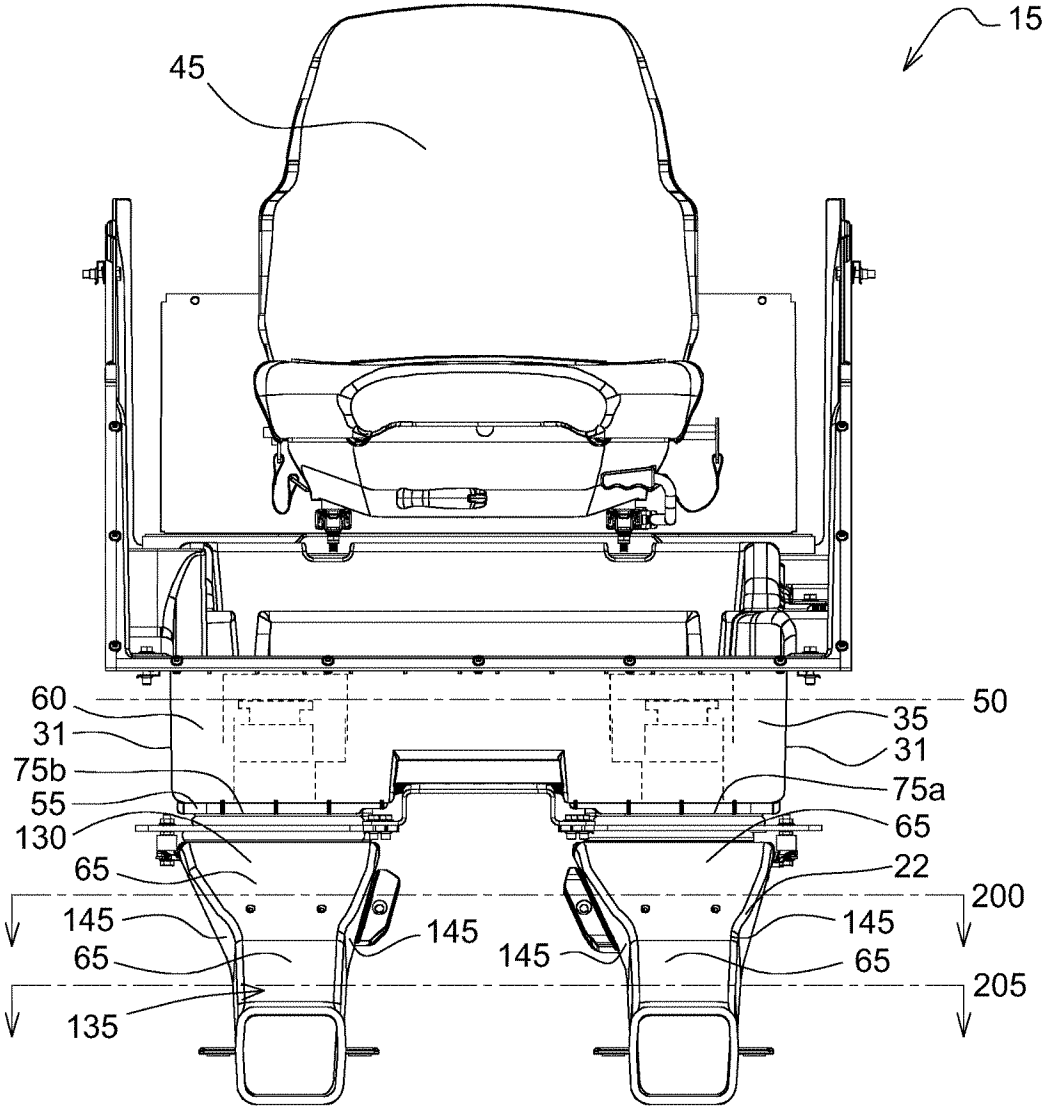
FIG. 4 is a front view of a portion of the operator's station showing a portion of the mainframe of the skid steer loader, a debris catch area, and the debris deflection apparatus in detail.

The operator's station 15 for a work vehicle 5 comprises a roof 25; a floor 30 wherein the floor 30 defines the debris catch area 35; a plurality of windows 40 extending between the floor 30 and the roof 25, and together with the floor 30 (as shown in FIG. 2) and the roof 25 defining an operator compartment that is enclosed on all sides; and an operator seat 45 supported on the floor 30 and disposed within the operator compartment. As shown in FIG. 1 and FIG. 4, the debris catch area 35 is disposed within the operator's station 15 and may extend below a first plane 50 parallel to the floor 30 of the operator's station 15. The debris catch area 35 comprises a plurality of walls 31 extending below the first plane 50 and a base 55, creating a pit 60. The debris catch area 35 may further define at least one footwell 75 located in the pit 60 of the debris catch area 35. An aperture 90 exists within each respective footwell 75 for the exit of debris during the cleaning of the operator compartment. In one embodiment the debris catch area 35 comprises of two footwells 75, a left footwell area 75*a* and a right footwell area 75*b*. However, it will be appreciated that the debris catch area 35 may comprise a singular large footwell traversing the areas of both the left and right footwells 75*a*, 75*b*. In an alternative embodiment, the floor 30 of the operator's station 15 may be acutely angled from a horizontal plane 65 parallel to the surface where the ground-engaging mechanism 10 contacts the ground, wherein the debris flows towards the debris catch area 35. In another embodiment, one or more apertures 90 may be present in the debris catch area 35 without a footwell 75. The debris deflection apparatus 20 comprises a deflector 22 positioned to receive debris from the debris catch area 35 and communicate the debris to an opening 125 defined by the work vehicle 5. In the embodiment shown in FIG. 4, the deflector 22 may be coupled to a footwell 75 defined by the debris catch area 35. Alternatively, the deflector 22 may be coupled to a debris catch area 35 without a footwell 75.

Referring now to FIG. 1, beneath the operator's station 15 are housed work vehicle components 95 such as a hydrostatic transmission, steering linkages, hydraulic lines and valves for powering the lift arms, bucket, and auxiliary functions, hydraulic lines for the wheel motor drives and miscellaneous electrical wiring harnesses and connections. The operator's station 15 may be moved to permit access to these work vehicle components 95 for maintenance, cleaning and related services. Common methods of moving include sliding the operator's station 15 forward, pivotally swinging it forward, or pivotally swinging it rearwardly. In the alternative, a side-wall may be swung open. In the alternative, as shown in FIG. 2 the work vehicle components 95 may also be accessed through removal of a belly pan 100. With current methods, debris buildup in the belly pan 100 is commonly found. Irrespective of the method of access, cleaning of work vehicle components 95 housed beneath an operator's station 15 is a manual and time-consuming process.

With continued reference to FIG. 2, a portion of the work vehicle 5 is shown in detail wherein the deflector 22 is assembled within the work vehicle 5. More particularly, FIG. 2 shows a portion of the operator's station 15, to which the deflector 22 is coupled to the debris catch area 35, with the mainframe 17 partially hidden. The other portion of the mainframe 17 is shown with the deflector 22 communicating to an opening 125 (shown by the hidden lines) defined by the work vehicle 5 with a cover 195.

Figure 3:
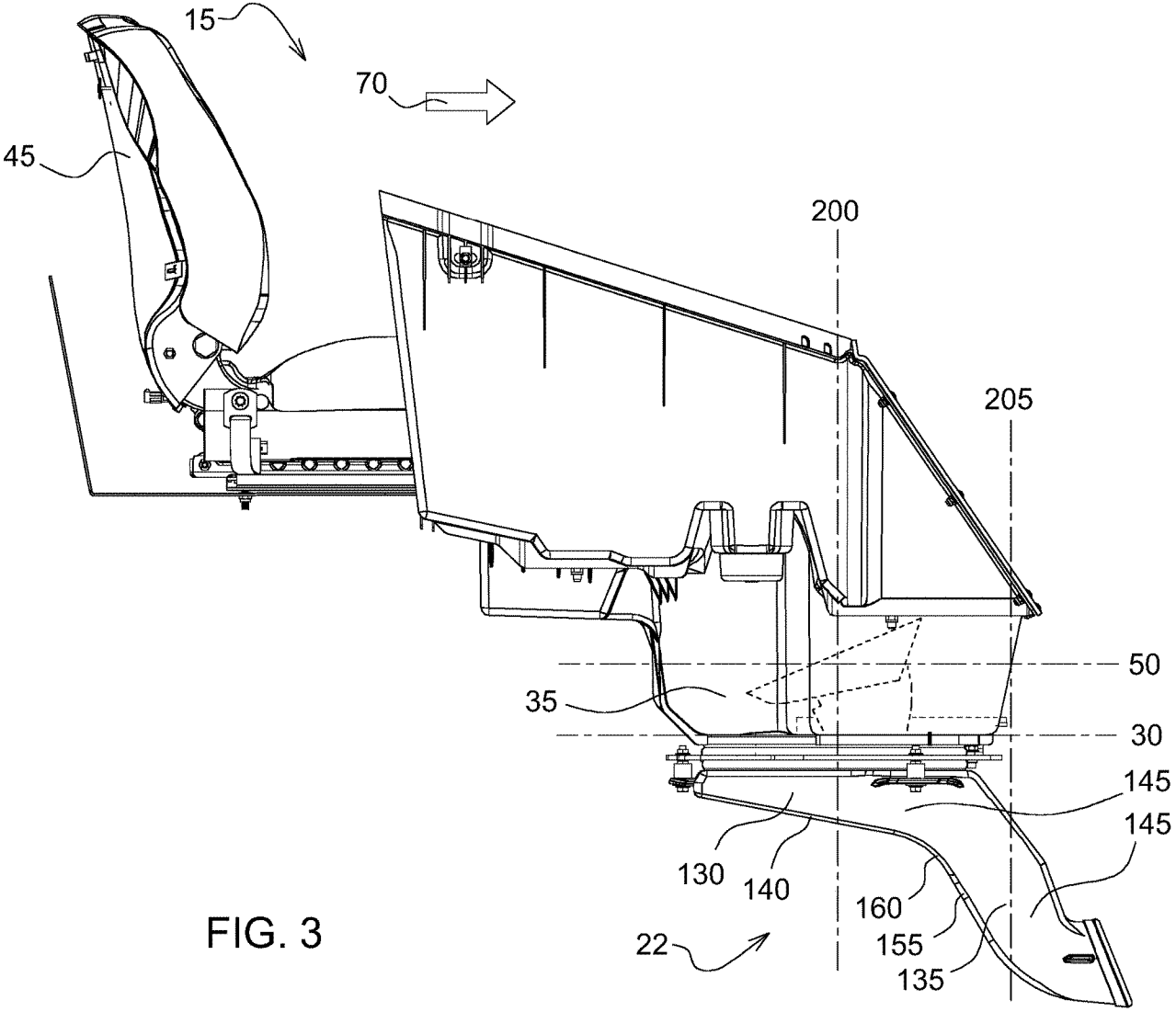
FIG. 3 is a side view of a portion of the skid steer loader of FIG. 1 showing the debris deflection apparatus in detail.
Figures 5, 5A:
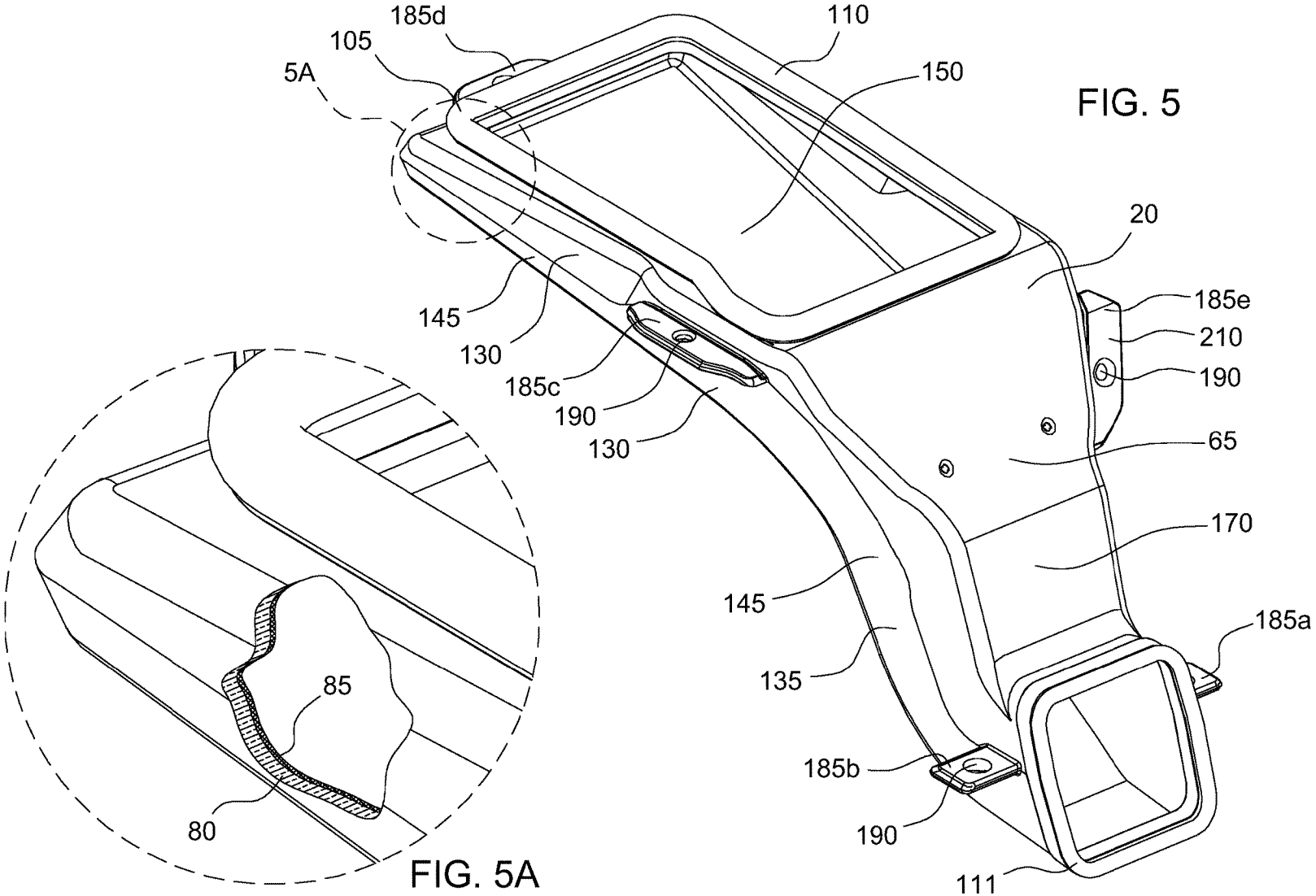
FIG. 5 is a perspective view of the debris deflection apparatus.
FIG. 5A is perspective view of a coating on the debris deflection apparatus.
Figure 6:
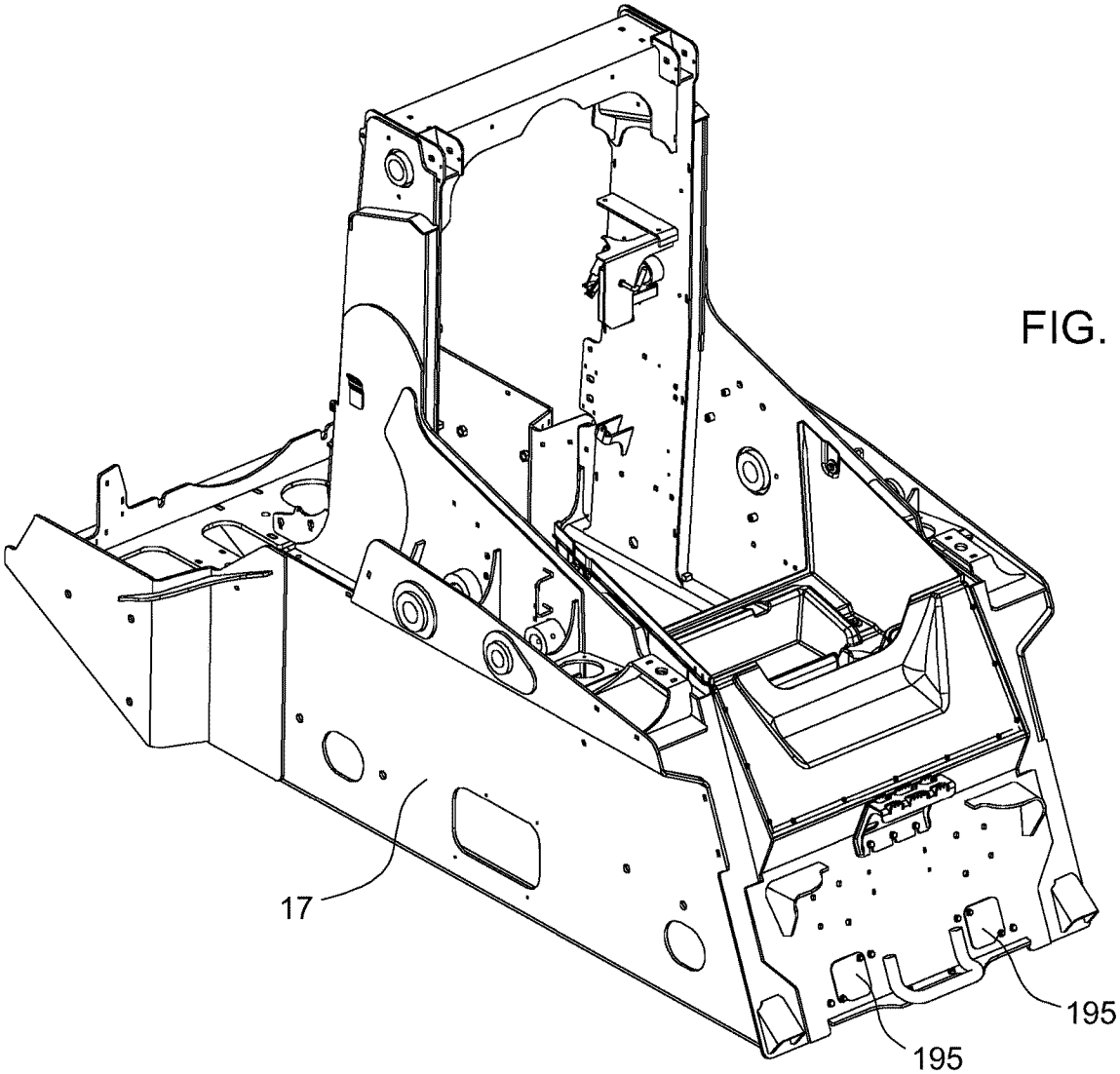
FIG. 6 is a perspective view of the mainframe of a work vehicle with the debris deflection apparatus located within.
Figure 7:
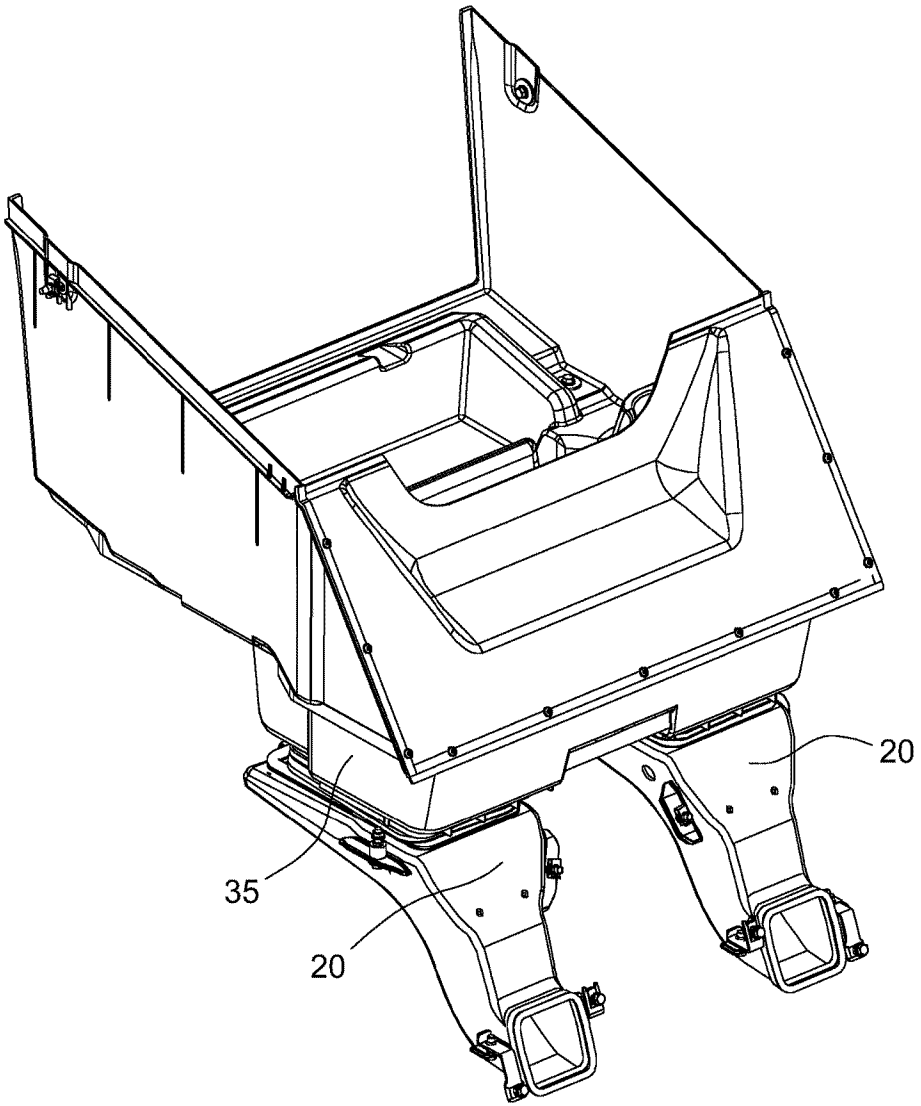
FIG. 7 is a perspective view of the debris catch area coupled with the debris deflection apparatus absent the mainframe.

Now referring to FIGS. 2, 3 and 5, the deflector 22 of the debris deflection apparatus 20 comprises a first portion 130, and a second portion 135. The first portion 130 is adapted to receive debris through the aperture 90 in the debris catch area 35. The first portion 130 is positioned proximal to the debris catch area 35 and within the mainframe 17 of the work vehicle 5. The second portion 135 is coupled to the opening 125 defined by the work vehicle 5 and adapted to receive debris from the first portion 130 and direct debris towards the opening 125. The second portion 135 is positioned within the mainframe 17 of the work vehicle 5. The first portion 130 comprises a first downwardly sloped surface 140 and upwardly extending sidewalls 145 configured to create a channel 150 to deflect debris away from work vehicle components 95 located below the operator's station 15. The first downwardly sloped surface 140 may be acutely angled relative to the first plane 50 parallel the floor 30 of the operator's station 15. The second portion 135 comprises a second downwardly sloped surface 155 at an angle different from the angle of the first downwardly sloped surface 140. In one embodiment, the second downwardly sloped surface 155 comprises an ogee-shaped curve 160. Two sidewalls 145 extend upwards along the length of the second downwardly sloped surface 155 wherein the two upwardly extending sidewalls 145 are coupled by one or more surfaces 65 creating a conduit 170 for debris to exit the mainframe 17 of the work vehicle 5. This conduit 170 communicates to the opening 125 defined by the work vehicle 5, thereby deflecting any debris away from a work vehicle component 95 located within the mainframe 17, and the belly pan 100.

Referring now to FIG. 3, a side view of the deflector 22 coupled with a portion of the operator's station 15 is presented. More particularly, the first portion 130 and the second portion 135 of the deflector 22 are shown. As can be seen in FIG. 3, a first cross-section 200 as defined by a frontal plane of the first portion 130 where the frontal plane is perpendicular to the first plane 50 parallel to the floor 30 of the operator's station 15. Frontal plane is defined as any vertical plane that divides a body into anterior and posterior sections. In this embodiment, the anterior section of the body is towards the direction when the operator faces forward 70 from the operator seat 45 and the posterior section is opposite the anterior direction. Similarly, a second cross-section 205 as defined by a frontal plane of the second portion 135 perpendicular to the first plane 50 defined by the floor 30 of the operator's station 15.

Referring now to FIG. 4, a front view of the deflector 22 with a portion of the operator's station 15 is shown. Here it becomes apparent that the first cross-section 200 of the first portion 130 is greater than the second cross-section 205 of the second portion 135.

The present invention is also concerned with the ability of the debris deflection apparatus 20 to withstand the weight of debris as it is flushed from the debris catch area 35 and onto the deflector 22. That is, the deflector 22 should not distend, warp, or flex in a way that interferes with a work vehicle component 95. Therefore, in one embodiment, the first portion 130 of the debris deflection apparatus 20 may comprise of one or more rigid materials 80 selected from a plastic, polymer, metal, wood, ceramic, or combination thereof (as shown in FIG. 5*a*). Similarly, the second portion 135 of the debris deflection apparatus 20 may also comprise of one or more rigid materials 80. Alternatively, the debris deflection apparatus 20 may comprise of rigid materials 80 in its entirety.

Now turning to FIG. 5*a*, in carrying out the present invention, the debris deflection apparatus 20 may further comprise a hydrophobic coating and/or an oleophobic coating 85.

Referring again to FIG. 2 and FIG. 5, the first portion 130 of the debris deflection apparatus 20 defines an upper perimeter 105 coupled to a perimeter seal 110. The perimeter seal 110 would prevent the spillage of debris and water from the debris catch area 35 and onto the work vehicle components 95 located within the mainframe 17. It is contemplated that such a perimeter seal 110 comprises a resilient material, such as rubber or plastic foam, that has a sufficient spring characteristic to allow the perimeter seal 110 to deform and tightly fill the space between the debris deflection apparatus 20 and the debris catch area 35 or any extension thereof. The resilient material allows the perimeter seal 110 to conform to any slight surface irregularities.

Similarly, in another embodiment it may be further desirable to attach a second perimeter seal 111 on the perimeter of the second portion 135 of the debris deflection apparatus 20 that communicates to the opening 125 defined by the work vehicle 5. In an alternative embodiment, the debris deflection apparatus 20 may further be coupled to the debris catch area 35 of the operator's station 15 or extension thereof, through a weld, adhesive, or fastener (not shown).

The deflector 22 may be secured to the mainframe 17 of the work vehicle 5 with one or more fasteners 210 (e.g., bolts, flanges trunions, clevises, or any other fastener). Referring now to FIG. 5, in one embodiment, the second portion 135 of the deflector 22 comprises two laterally extending wings 185*a* and 185*b* located on opposite surfaces of one another with through-holes 190 for coupling the deflector 22 to the mainframe 17 (not shown). Other extending wings, 185*c*, 185*d*, and 185*e* provide additional areas of securing the deflector 22 to the mainframe 17 (not shown).

Figure 8:
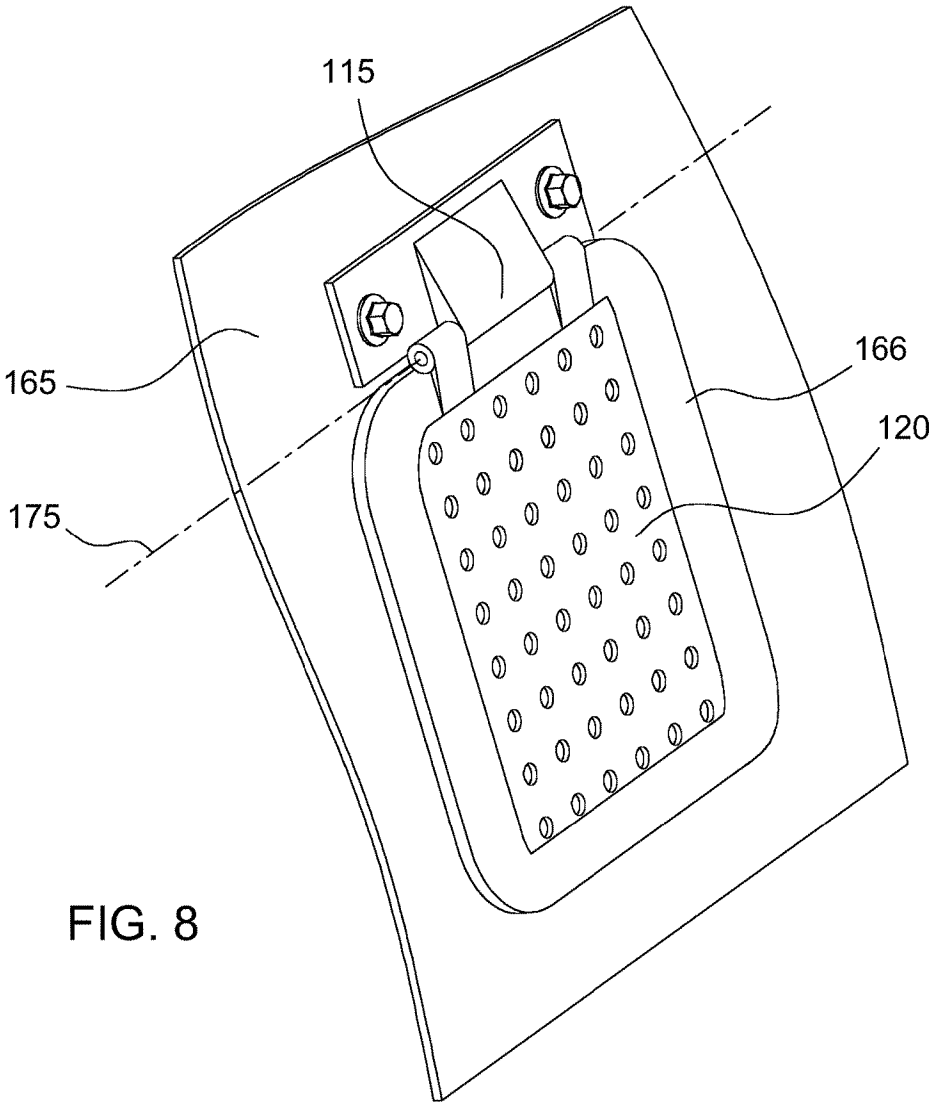
FIG. 8 is a perspective view of an embodiment of a cover comprising a plate coupled with a hinge coupled to a surface of the work vehicle.

Now referring to FIGS. 2 and 8, it will be seen that the opening 125 defined by the work vehicle 5 may be shielded with a cover 195. However, the opening 125 is accessible when the operator's station 15 is flushed with water for cleaning, or when the debris deflection apparatus 20 is cleaned. It is contemplated that such a cover 195 could comprise of a plate 166 coupled to a surface 165 of the work vehicle 5. In an alternative embodiment, the cover 195 may comprise of a plate 166 coupled with a hinge 115 secured to surface 165 of the work vehicle 5. Another embodiment for the cover 195 may include a spring-loaded flap (not shown) that stays in a substantially closed position. The flap (not shown) is pivotable around an axis 175 with a spring-loaded hinge coupled to a portion of the flap. The spring-loaded hinge exerts a closing moment on the flap in the closed position. In each of the aforementioned cover embodiments, the cover 195 may comprise a screen 120, or in the alternative, sufficiently small holes wherein the debris accumulates within the conduit 170 until manual removal, while allowing water to flow through. The above description is not intended to limit the disclosure to the precise forms of the cover 195 described. The cover 195 may be the form of any movable or removable enclosure.

The embodiments of the present disclosure are not intended to be exhaustive or to limit the disclosure to the precise forms in the following detailed description. Rather, the embodiments are chosen and described so that others skilled in the art may appreciate and understand the principles and practices of the present disclosure.

What is claimed is:

1. A debris deflection apparatus for a work vehicle, the work vehicle comprising a mainframe and an operator's station coupled to the mainframe, the operator's station defining a floor having a debris catch area, the debris deflection apparatus comprising:

a deflector positioned to receive debris from the debris catch area and communicate the debris to an opening defined by the work vehicle.

2. The debris deflection apparatus according to claim 1, the debris catch area defining at least one footwell with at least one aperture, wherein the deflector is coupled with the footwell.

3. The debris deflection apparatus according to claim 1, wherein the deflector comprises:

a first portion adapted to receive debris through the aperture in the debris catch area wherein the first portion is positioned proximal to the debris catch area and a second portion coupled to the opening and adapted to receive debris from the first portion and direct debris towards the opening, wherein the second portion is positioned within the mainframe of the work vehicle.

4. The debris deflection apparatus according to claim 3, wherein the first portion further comprises a first downwardly sloped surface and upwardly extending sidewalls configured to create a channel to deflect debris away from a work vehicle component below the operator's station.

5. The debris deflection apparatus according to claim 4, wherein the first downwardly sloped surface is at an acute angle relative to a first plane parallel to the floor of the operator's station.

6. The debris deflection apparatus according to claim 4, wherein the second portion further comprises a second downwardly sloped surface at an angle different from the angle of the first downwardly sloped surface.

7. The debris deflection apparatus according to claim 6, wherein the second downwardly sloped surface further comprises an ogee-shaped curve.

8. The debris deflection apparatus according to claim 6, wherein the second portion further comprises two sidewalls extending towards the first plane along the length of the second downwardly sloped surface.

9. The debris deflection apparatus according to claim 8, wherein the two sidewalls are coupled by at least a surface creating a conduit communicating to the opening in the work vehicle.

10. The debris deflection apparatus according to claim 3, wherein at least one of the first portion and the second portion comprise a rigid material.

11. The debris deflection apparatus according to claim 10, wherein the first portion and the second portion further comprise at least one of a hydrophobic coating and an oleophobic coating.

12. The debris deflection apparatus of claim 3, wherein a first cross-section as defined by a frontal plane of the first portion where the frontal plane is perpendicular to a first plane parallel to the floor of the operator's station is greater than a second cross-section as defined by a frontal plane of the second portion that is perpendicular to the first plane.

13. The debris deflection apparatus according to claim 3, wherein the first portion defines an upper perimeter coupled to a perimeter seal.

14. The debris deflection apparatus according to claim 13, wherein the perimeter seal comprises a resilient material configured to deform and tightly fill a space between the first portion and the debris catch area.

15. The debris deflection apparatus according to claim 3, wherein the deflector is coupled to the mainframe of the work vehicle with a fastener.

16. A work vehicle having a mainframe, an operator's station coupled to the mainframe, the operator's station defining a floor having a debris catch area, the work vehicle comprising a:

a debris deflection apparatus coupled to the debris catch area wherein the debris deflection apparatus is positioned to receive debris from the debris catch area and communicate the debris to an opening defined by the work vehicle.

17. The work vehicle of claim 16, wherein the debris deflection apparatus comprises: a first portion adapted to receive debris through an aperture in the debris catch area wherein the first portion is positioned proximal to the debris catch area and within the mainframe of the work vehicle, and a second portion coupled to the opening and adapted to receive debris from the first portion and direct debris towards the opening, wherein the second portion is positioned within the mainframe of the work vehicle.

18. The work vehicle of claim 16, wherein the opening defined by the work vehicle is shielded with a cover.

19. The work vehicle of claim 18, wherein the cover comprises a plate coupled with a hinge coupled to a surface of the work vehicle.

* * * * *